United States Patent [19]

Röck et al.

[11] Patent Number: 4,558,485

[45] Date of Patent: Dec. 17, 1985

[54] FURNITURE HINGE INCLUDING C-SHAPED MEMBER FOR MOUNTING HINGE LINKS TO HINGE CASING

[75] Inventors: Erich Röck, Höchst; Klaus Brüstle, Lauterach, both of Austria

[73] Assignee: Julius Blum Gesellschaft m.b.H., Höchst, Austria

[21] Appl. No.: 586,766

[22] Filed: Mar. 6, 1984

[30] Foreign Application Priority Data

Mar. 21, 1983 [AT] Austria ..... 976/83

[51] Int. Cl.[4] ..... E05D 3/06

[52] U.S. Cl. ..... 16/370; 16/386

[58] Field of Search ..... 16/282, 286, 287, 294, 16/302, 366, 370, 379, 386

[56] References Cited

U.S. PATENT DOCUMENTS 4,366,599 1/1983 Zimmer et al. ..... 16/386
4,368,559 1/1983 Oepping et al. ..... 16/386

FOREIGN PATENT DOCUMENTS 1285913 12/1968 Fed. Rep. of Germany ..... 16/386
2029843 5/1978 Fed. Rep. of Germany ..... 16/302

*Primary Examiner*—Fred A. Silverberg
*Attorney, Agent, or Firm*—Wenderoth, Lind & Ponack

[57] ABSTRACT

A hinge includes two hinge links connecting a hinge casing and a hinge arm. In the hinge casing both hinge links are pivotable on a common member having the form of a C. One hinge link is mounted on an intermediate part, an the other hinge link is conducted on two outer ends of the C that constitute pivot pins.

10 Claims, 7 Drawing Figures

FURNITURE HINGE INCLUDING C-SHAPED MEMBER FOR MOUNTING HINGE LINKS TO HINGE CASING

FIELD AND BACKGROUND OF THE INVENTION

The invention relates to a hinge, in particular for furniture doors, comprising a hinge arm or the like mountable on the furniture body and a hinge casing insertable into a recess in the furniture door, the hinge arm and hinge casing being connected by means of hinge links, one of the hinge links being mounted on pivot pins projecting from the hinge casing wall into the interior of the casing, and the other of the hinge links being mounted on a hinge axle extending through the hinge casing.

DESCRIPTION OF THE PRIOR ART

In general, the two hinge links of such a hinge are mounted on two hinge axles on the hinge arm and on two axles in the hinge casing. In particular, when further hinge parts are to be mounted on the hinge casing, for example parts of closing or locking means, or there is to be a swivel action of the hinge of more than 90°, it may occur that two hinge axles projecting through the hinge casing require too much space. In some cases it is, therefore, desired that one of the hinge links be mounted on two pivot pins projecting from the wall of the hinge casing and that the space between such two pivot pins remains free. Thus, a greater opening angle of the hinge can be obtained. This kind of mounting causes difficulties in connection with hinges, because the wall of the housing must be a very solid structure to provide sufficient alignment of the pivot pins also when under stress. In particular in the case of deep-drawn steel casings, the wall is very thin only and is not able to provide sufficient support for the projecting pivot pins.

It has been attempted to solve this problem in such a manner that each pivot pin has been designed as an end of a bow-shaped axle comprising a bow-shaped part and a straight part, and that the straight parts of both axles extend transversely through the hinge casing.

Thus, the desired anchoring and alignment of the pivot pins were obtained, but the desired advantage with respect to space was lost, because there were two pins extending transversely through the hinge casing, as in the case of conventional hinges.

Moreover, this design required a greater amount of material for the hinge axles, which obviously causes disadvantages in connection with a mass produced article of this type.

SUMMARY OF THE INVENTION

It is the object of the invention to provide a hinge of the afore-mentioned kind in which an exact alignment and a solid support for the pivot pins of a hinge link in the hinge casing is obtained, and in which the interior of the hinge casing is to the greatest possible extent free of structural parts of the hinge axles.

According to the invention this is obtained in that the structural parts of the hinge axles together form a single C-shaped bow member.

It is advantageously provided that the two pivot pins of one of the hinge links are by means of connecting flanges linked to the hinge link axle of the second of the hinge links, at least one of such pivot pins being fastened to the hinge link axle by means of a special connection, for example welded or riveted thereto.

One embodiment provides that the connecting flanges of the pivot pins rest against the outer side of the hinge casing.

A further embodiment of the invention provides that the hinge axle is bent to form the second pivot pin for the second hinge link.

In order to improve the connection between the hinge link axles and the hinge casing, a further embodiment provides that the connecting flanges of the pivot pins are flattened at least at the respective sides directed towards the hinge casing.

BRIEF DESCRIPTION OF THE DRAWINGS

Below embodiments of the invention will be described in greater detail with reference to the accompanying drawings, wherein.

DETAILED DESCRIPTION OF THE INVENTION

Figure 1:
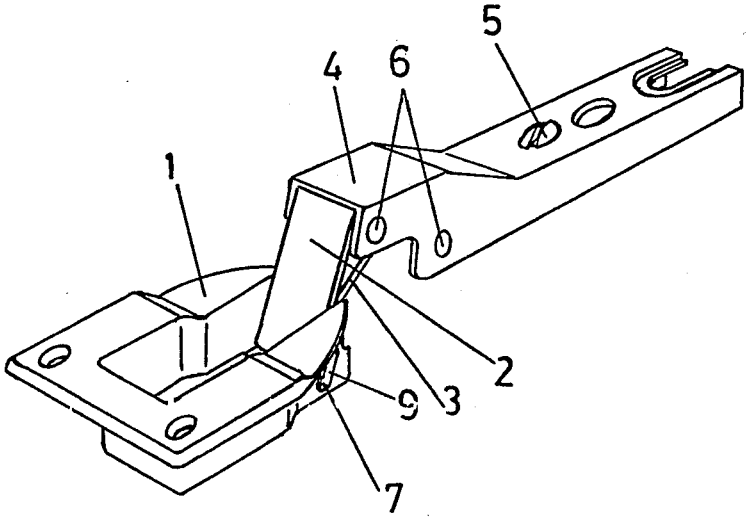
FIG. 1 is a perspective diagrammatic view of a hinge according to the invention.
Figure 2:
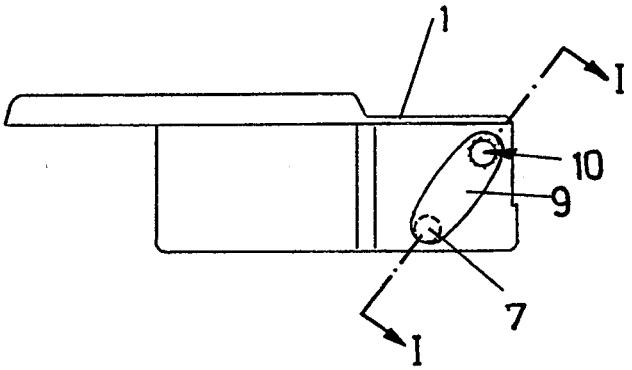
FIG. 2 is a side view of the hinge casing thereof.

As can be seen from FIG. 1, the hinge according to the invention includes a dowel casing 1 which is connected with a hinge arm 4 by means of two hinge links 2,3. The hinge arm 4 is to be fastened to a base plate mounted at a furniture side wall by means of screws 5. The base plate and the mounting of the hinge are not described in detail, because they do not form the subject of the present invention and can be designed according to the known state of the art.

The hinge links 2,3 are mounted on the hinge arm by means of hinge axles 6.

Figure 3:
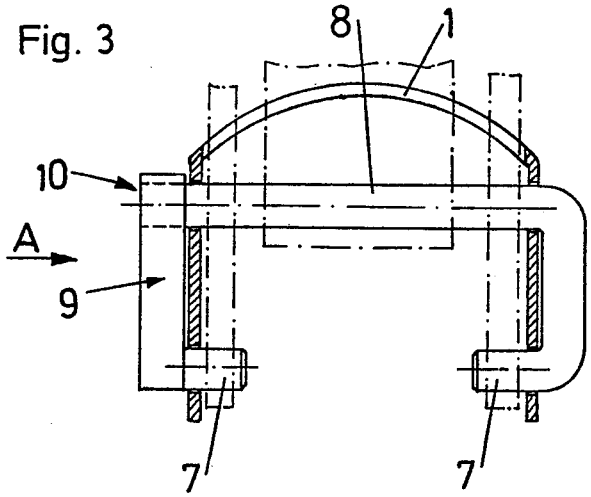
FIG. 3 is a sectional view along line I—I of FIG. 2.

The outer hinge link 2 is mounted on hinge casing 1 by pivot pins 7, and the inner hinge link 3 is mounted on a hinge axle 8 (see FIG. 3). The outer hinge link 2 is, at least at the pivot pins 7, U-shaped.

In the embodiment according to FIG. 3, the right pivot pin 7 is molded to or integral with the hinge axle 8, and the left pivot pin 7 is designed as a separate part with respect to the hinge axle 8 and is fastened by a connecting flange 9 to the hinge axle 8 at a joint 10. Flange 9 and the integral portion extending between the right pin 7 and the axle 8 define transverse portions connecting pins 7 and axle 8.

Figure 4:
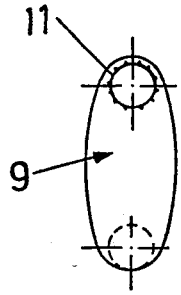
FIG. 4 is a view from the direction of arrow A of FIG. 3.
Figure 5:
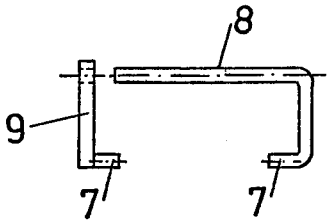
FIG. 5 is a schematic view of the design of the hinge axle and of the pivot pins.

Fastening a flange 9 to axle 8 can be obtained by welding, riveting or the like. In the embodiment according to FIG. 3, connection by means of riveting is shown, and FIG. 4 shows the connecting flange 9 which has a hole 11 through which, in the mounted position, the hinge axle 8 projects and is riveted therein. To improve the fit between the flange 9 and the hinge axle 8, axle 8 may at its end be provided with a knurled portion. The wall of the hole 11 may also be provided with such a knurled portion. The flange 9 is flattened, advantageously at least at the side directed towards the dowel casing 1.

Figure 6:
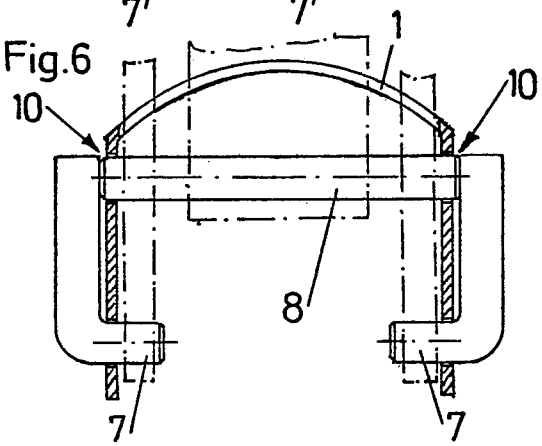
FIG. 6 is a sectional view similar to FIG. 3 but of a second embodiment of the invention.
Figure 7:
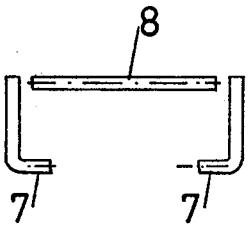
FIG. 7 is a schematic view of the hinge axle and the pivot pins according to the embodiment of FIG. 6.

In the embodiment according to FIG. 6, both pivot pins 7 are separate parts with respect to the hinge axle 8, and they are joined, e.g. by welding, at joints 10 to the hinge link axle 8 by means of connecting flanges 9. In the illustrated embodiment of FIG. 6 the hinge axle 8 abuts against the connecting flanges 9. As in the case of the embodiment of FIG. 3, holes or other recesses may be provided in the connecting flanges 9 to obtain positive locking between the connecting flanges 9 and the hinge axle 8.

It may further be provided that the connecting flanges 9 do not extend over the entire diameter of the hinge axle 8 to provide a better support for the welding material.

What is claimed is:

1. A furniture hinge comprising:

a hinge arm to be mounted on a furniture body;

a hinge casing to be inserted into a recess in a furniture door;

first and second hinge links having first ends pivoted to said hinge arm and second ends pivoted to said hinge casing;

a single C-shaped member pivotally mounting said second ends of said first and second hinge links to said hinge casing, said member comprising a single hinge axle extending through spaced walls of said hinge casing through the interior thereof, transverse portions integral at first ends thereof with opposite ends of said hinge axle and extending transversely thereof, and pivot pins integral with second ends of said transverse portions and extending transversely therefrom and substantially parallel to the hinge axle through said walls of said hinge casing into said interior thereof, with a space between said pivot pins, wherein said pivot pins extend toward each other along substantially the same axis;

said first hinge link being pivotally mounted on said hinge axle; and said second hinge link being pivotally mounted on said pivot pins.

2. A hinge as claimed in claim 1, wherein said transverse portions contact outer sides of said walls of said hinge casing.

3. A hinge as claimed in claim 1, wherein said space between said pivot pins is sufficient to enable passage therebetween of said first hinge link.

4. A hinge as claimed in claim 1, wherein said transverse portions have flattened surfaces directed toward respective said walls of said hinge casing.

5. A hinge as claimed in claim 1, wherein a first said transverse portion is formed integrally with said hinge axle and with the respective said pivot pin, and a second said transverse portion comprises a flange connected at said first end thereof to said hinge axle.

6. A hinge as claimed in claim 5, wherein said flange is welded to said hinge axle.

7. A hinge as claimed in claim 5, wherein said flange is riveted to said hinge axle.

8. A hinge as claimed in claim 1, wherein both said transverse portions comprise flanges connected at said first ends thereof to said hinge axle.

9. A hinge as claimed in claim 8, wherein said flanges are welded to said hinge axle.

10. A hinge as claimed in claim 8, wherein said flanges are riveted to said hinge axle.

* * * * *